United States Patent [19]

Smith

[11] 4,059,411

[45] Nov. 22, 1977

[54] METHOD FOR EXTENDING THE LOWER LEAN LIMIT OF RUNNING OF INTERNAL COMBUSTION ENGINES AND IMPROVING THE COMBUSTION OF FLUID FUELS

[76] Inventor: Marvin M. Smith, 1010 E. Parkway Drive, Muncie, Ind. 47304

[21] Appl. No.: 673,293

[22] Filed: Apr. 2, 1976

Related U.S. Application Data

[63] Continuation-in-part of Ser. No. 605,534, Dec. 20, 1966, abandoned, Ser. No. 89,048, Nov. 12, 1970, abandoned, Ser. No. 289,973, Sept. 18, 1972, abandoned, Ser. No. 469,612, May 13, 1974, abandoned, and Ser. No. 545,730, Jan. 30, 1975, abandoned.

[51] Int. Cl.[2] ..... C10L 1/32

[52] U.S. Cl. ..... 44/51; 44/62

[58] Field of Search ..... 44/51, 62, 53, 77

[56] References Cited

U.S. PATENT DOCUMENTS

| | | | |
|---|---|---|---|
| 1,444,723 | 2/1923 | Bates | 44/51 |
| 2,927,849 | 3/1960 | Greblick et al. | 44/51 X |
| 3,502,451 | 3/1970 | Moore et al. | 44/62 X |

*Primary Examiner*—Carl F. Dees
*Attorney, Agent, or Firm*—Chas. W. Rummler

[57] ABSTRACT

A fuel composition is disclosed comprising a major portion, in the order of 94% by weight, of a liquid fuel such as gasoline mixed with a minor portion, in the order of 6% by weight, of particulates generally similar to particulates of polyvinyl alcohol of about 10 to 40 microns in size. These particulates are suspended in and are small enough to be metered along with the liquid fuel in a conventional automobile carburetor and when this fuel composition is burned in the combustion chamber of internal combustion engines, the particulates function as nuclei for droplets of the carrier fuel which act as combustion promotion agents in the dry vapor charge at the instant of combustion to intensify the burning process to extend the low lean limit of consistent and regular engine firing and to reduce $NO_x$. A similar composition of liquid fuel in open flame combustion results in a much improved heat transfer efficiency of the energy in the fuel.

3 Claims, No Drawings

METHOD FOR EXTENDING THE LOWER LEAN LIMIT OF RUNNING OF INTERNAL COMBUSTION ENGINES AND IMPROVING THE COMBUSTION OF FLUID FUELS

RELATED APPLICATIONS

This application is a continuation-in-part of my applications Ser. No. 605,534 filed Dec. 20, 1966 (abandoned), its continuation-in-part Ser. No. 89,048 filed Nov. 12, 1970 (abandoned), Ser. No. 289,973 filed Sept. 18, 1972 (abandoned), Ser. No. 469,612 filed May 13, 1974 (abandoned) and Ser. No. 545,730 filed Jan. 30, 1975 (abandoned).

BACKGROUND OF THE INVENTION

The Congress of the United States in the Clean Air Act of 1968 has specified certain limiting exhaust gas emission levels for internal combustion engines. The deleterious effect of air pollution on personal health and on the nation's ecology is a matter of common knowledge and concern and it is now a matter of public record that nitrous oxide, nitrogen dioxide, carbon monoxide and unburned hydrocarbon emission control, by use of post-combustion or exhaust gas recirculatory and/or catalytic devices connected to the exhaust pipe, is the direction that research on pollution control is presently taking. Such automotive accessory devices are expensive in the first cost and costly to maintain.

The problem of controlling nitrous oxide, nitrogen oxide, carbon monoxide and hydrocarbon emission at the source of formation, rather than by expensive catalytic devices connected to the exhaust pipe, is primarily one of lowering the peak cyclical combustion temperature at the flame front in the combustion chamber by stoichiometric combustion in lean fuel-air ratios for purposes of reducing the nitrous oxide and nitrogen dioxide formation, as well as completing combustion therein of the hydrocarbons and the carbon monoxide to harmless carbon dioxide and water by oxidation promotion, as disclosed in my prior co-pending applications.

The result of governmental agency regulation activity is that the industry has literally been placed on the horns of a dilemma. It has had to choose between (1) lowering the carbon monoxide, unburned hydrocarbon and nitrous oxide emission from its engines by improved engine carburetion, manifold distribution and borderline misfire engine operation at very lean fuel-air ratios, or (2) lowering the nitrous oxide and nitrogen dioxide emission therefrom by running the engines at richer, smoother-running mixtures and eliminating the consequent high carbon monoxide and unburned hydrocarbons by the use of post-combustion or exhaust gas recirculatory and/or platinum catalytic devices, or (3) running the engines at slightly less rich mixtures for better economy in miles per gallon and then meeting the stiff 90% reduction in nitrous oxide and nitrogen dioxide emission requirement, and the carbon monoxide and hydrocarbon emission requirement, by suitable catalytic devices. Needless to say, with regard to (2) and (3), such devices are expensive in the first instance and costly to maintain.

The mixture of fuel and air used as the working medium in an internal combustion engine is subject to chemical, thermal and mechanical changes during the course of its passage through the engine. As a first approximation the commonly known "Air Cycle" is presumed to use air as the working medium. Modification of this cycle to take into consideration the special characteristics of combustible dry-vapor fuel air mixtures and their composition products gives the well-known "Fuel-Air Cycle." The "Fuel-Air Cycle" becomes the "Actual Cycle" when it is modified to account for combustion losses, time losses, direct heat losses and leakage. The useful work left after the friction losses are subtracted from the work of the "Actual Cycle" determines the work output of the engine.

At a constant compression ratio, the dry-vapor "Fuel-Air Cycle" efficiency fails very rapidly because of incomplete utilization of fuel as the fuel-air ratio increases beyond the chemically-correct ratio. As mixtures become leaner than chemically correct, the temperatures of combustion and expansion become lower and the losses due to high specific heat and to incomplete chemical combination are correspondingly reduced so that there is an improvement in efficiency with decreasing fuel-air ratio which approaches air-cycle efficiency as the amount of fuel used becomes extremely small compared to the amount of air used. With a very low fuel-air ratio, the medium would consist, substantially, of air throughout the cycle, and since the temperature range would be small, the air would behave very nearly as a perfect gas. The air-cycle efficiency thus constitutes a limit which the efficiency of the dry-vapor fuel-air cycle approaches as the fuel-air ratio leans out. In practice there is, however, a limiting fuel-air ratio below which stable combustion cannot be sustained in dry-vapor fuel-air mediums. Also, there are additional losses in efficiency in the "actual cycle" due to excessively slow combustion with lean mixtures.

There is thus an established need for a means to accelerate and sustain stable combustion of dry-vapor fuel-air mixtures below current low lean limit fuel-air ratios if greater fuel-air cycle and actual cycle efficiencies than currently experienced are to be realized. It is the object of my invention to meet this need.

SUMMARY OF THE INVENTION

The gist of my invention resides in providing a charge for an internal combustion engine comprising a major portion of a dry vapor, combustible automotive fuel-air mixture in which is suspended and uniformly distributed a minor portion of a multiplicity of liquid-feed-bearing micro-particulates, such as solid or hollow particles of polyvinyl alcohol or other combustible material of about 10 to 40 micron size. Particulates of this size are small enough to be metered along with the major portion of the liquid fuel in a conventional carburetor or injection system and remain suspended in the dry-vapor fuel-air mixture introduced into the induction system of the engine.

The particulates transport fuel into the combustion chamber of the internal combustion engine either as a fuel-wetted liquid film, held by forces of adhesion and surface tension on the surfaces of the particulates, or as a fuel-containing liquid core enclosed within fuel-wetted hollow micro-encapsulates, or both. These fuel-carrrying particulates which are transported into the combustion chamber with the normal fuel-air charge are substantially uniformly distributed throughout the charge and upon firing of the charge are engaged progressively by the advancing frame front and at that time they individually release the fuel they carry for delayed vaporization and burning.

The combustion-promoting effectiveness of the fuel-wetted micro-particulates lies in the film of liquid fuel carried on the surface thereof. Surface-wetting of such micro-particulates generates forces of adhesion to, as well as forces of surface tension in, the liquid fuel constituting said films. Both surface tension forces in and forces of adhesion of these films to the particulate affect the vaporization characteristics of the liquid fuel of which these films are constituted rendering them less volatile at the temperatures and pressures within the combustion chamber of the engine before burning is reached. Reduced and hence delayed volatilty of liquid fuel in these films develops a combustion-promoting effect for the dry vapor charge within the combustion chamber because the burning velocity of the whole charge therein is accelerated and the leanward region of stable burning is extended by reason of the delayed burning of the multiplicity of uniformly-distributed, locally-rich flaming nuclei within the normal burning zone of the ambient, dry-vapor fuel-air charge.

This has been demonstrated by tests conducted at a principal automotive testing laboratory where iso-octane was used as the main fuel and the particulate matter comprised a mixture of solid polyvinyl alcohol particles and encapsulates of the same material containing iso-octane, the particulate matter, both solids and capsules, being an amount equivalent to about 6% by weight of the total fuel and particulate composition employed and being in the size range of about 10 to 40 microns.

But since there appears to be an optimum number of particulate-nuclei carried fuel droplets necessary to produce the desired results and since the specific gravity of the material used as particulates as well as particulate size are factors determining the number of particles in the 6% by weight recommended and as used in the before mentioned tests, materials other than polyvinyl alcohol used as fuel droplet nuclei should be of a comparative amount and percentage in accordance with their specific gravity factor as compared with the specific gravity factor of polyvinyl alcohol.

For example, to determine the weight of any suitable 10 to 40 micron size particulate matter for use in the practice of the herein disclosed invention, in order to maintain the optimum number of particles based upon the proven formula of 6% by weight of polyvinyl alcohol having a specific gravity of 0.9 and 94% by weight of hydrocarbon fuel, the conversion equation will be $X = (Spg \times 6)/0.9$ where $X = \%$ by weight of the new material to be used and $Spg =$ the specific gravity of the new material.

Thus, if powdered coal with particle size range of 10–40 microns and a specific gravity of 1.4 were to be used as the particulate material, the percent by weight of the powdered coal needed would be $(1.4 \times 6)/0.9$ or 9.33% of the total fuel and particulate composition.

Likewise, for powdered charcoal particles of the same 10–40 micron size range and a specific gravity of 0.45, the percent by weight of charcoal to make the total fuel and particulate composition would be $(0.45 \times 6)/0.9 \times 3\%$.

The film on the surface of each micro-particulate has the capability of remaining liquid in the combustion chamber of the engine at temperatures and pressures normally associated with that productive of a saturated vapor state and in so doing, makes the fuel-wetted micro-particulate a combustion-promoting agent. Forces of surface tension in and adhesion of the particulate to the film delay the vaporization of liquid film from the surfaces of these micro-particulates through the preheat zone of the flame front and into the region of burning out of the ambient charge and effectively extend the low lean limit of combustion stability thereof. This is done by providing a multiplicity of rich flaming nuclei, as combustion promoting agents, at the instant of combustion which creates a multiplicity of small scale turbulences in the flame front and in so doing exposing more surface of the flame front to the air at a given point and time thus creating a much more rapid and complete oxidation of the ambient charge which is the source of the flame front combustion.

The wetted particulates contained in the charge are run over by the rapidly progressing flame front in the combustion chamber to be taken progressively into the burning zone in contra-distinction to total instantaneous ignition. There, after delayed ignition, they burn as flaming nuclei as they individually vaporize their separate films within the body of the reaction zone where heat interchange with the originally smooth advancing flame surface of the ambient dry-vapor charge takes place, creating small-scale turbulence therein and expanding the surface area thereof as high temperature sources of heat accelerate local burning velocities of adjacent flame elements and stabilize ignition of the unburned remainder of the charge at lean fuel-air ratios. Burning velocity also accelerates because the flame propagates through the regions of optimum fuel-air ratio formed about the evaporating film nuclei. Small scale turbulence generated by a multiplicity of randomly located burning fuel-wetted particulates causes complex local thermal expansion of the gas which intensifies the high-temperature energy transport process from fuel-rich flaming nuclei to fuel-lean ambient charge.

DESCRIPTION OF THE PREFERRED EMBODIMENT

For purposes of definiteness and clarity of meaning, the following definitions will apply:

1. A "combustion promoting agent" is any solid, liquid or gaseous additive to the charge of a combustion chamber which promotes the acceleration of burning velocity and leanward extension of the region of stable burning of the charge therein by means of a coexistent two-phase, vapor-liquid system rather than a single vapor phase mixture.

2. A "liquid-fuel vaporization-suppressant" is any liquid-fuel-bearing particulate which, by reason of adhesion to or surface tension forces in the liquid film thereon, suppresses vaporization therefrom of the amount of liquid fuel borne thereby.

3. A "major portion" is meant to be an amount in the order of 94% by weight of liquid fuel and particulate composition before vaporization, and a "minor portion" is meant to be an amount in the order of 6% by weight of the liquid fuel and particulate composition, compared to polyvinyl alcohol at about 0.9 specific gravity, as disclosed in the test data, Exhibits A through H, filed herewith. (Originally filed on or about July 18, 1973, in Application Ser. No. 289,973 filed Sept. 18, 1972, now abandoned, of which this application is a third continuation-in-part.)

4. A "liquid-fuel-bearing micro-particulate" is a solid or hollow particle in the size range of about 10 to 40 microns and which is externally wetted by a film of liquid fuel. If hollow, the particulate may also contain a liquid or solid fuel.

Experiment has shown that the carburetion of a fuel similar to and comprising a major portion of conventional gasoline and a minor portion of a plurality of liquid-fuel-bearing plastic polymer particulates of 10 to 40 micron size and the charging of the same into the combustion chamber of an internal combustion engine provides a means for attacking the $NO_x$ pollution problem at its very source. It does this by substantially preventing the formation of the same within the combustion chamber. For example, a reduction in $NO_x$ emission is realized from three sources: (1) an $NO_x$ formation reduction from cooler combustion in the immediate vicinity of the fuel-bearing particulate by chemical means as the fuel-air ratio is increased by the addition of the fuel contained on the surface of the particulates, (2) an $NO_x$ formation reduction from cooler combustion in the ambient charge by reason of the lower heating value of the lean fuel-air mixture therein, and (3) an $NO_x$ formation reduction by the cooling effect on the peak temperatures of the flame front due to the abstraction of heat by the latent heat of vaporization of the liquid fuel contained on the surface of the particles as a film which is released therefrom as they are consumed by flame.

The method of making or getting the particulates into the combustion chamber is important only insofar as they are wetted by a film of a fuel and are in suspension in the dry vapor in the combustion chamber at the instant of combustion. Interfacial adhesive and surface tension forces on and in the fuel wetted on the particulates must resist breakdown long enough to delay the vaporization of the fuel on the wetted surface until released by the superior forces of the flame front and in so doing add to the local richness of the fuel-air mixture in a normally lean charge to achieve a spot stratification action within the burning zone and provide near stoichiometric combustion of the released vapor.

The suspension of the particulates in the fuel will not normally be colloidal and continuous or intermittent agitation can be applied to maintain the suspension at the time of use of the fuel. Also, the particulate, whether added into the liquid fuel or added into the vapor before it enters the combustion chamber, must be insoluble in the carbonaceous fuel material. Preferably the platic polymer material for forming the particulates is a polymerized wax-type, cellulose-type or polyalkane-type material since on combustion, principally carbon dioxide and water are formed. Illustrative are the ethyl cellulose materials; vinyl related polymers, e.g. polyethylene or polypropylene; and those vinyl polymers and co-polymers of the so-called wax type which are adaptable for use in micro-encapsulation.

The liquid fuel used in the compositions of this invention can be any carbonaceous material including and illustrated by hydrocarbons boiling in the gasoline boiling range, various blends of gasoline hydrocarbons, aviation gasoline, octane, and mixtures thereof whether used as the ambient charge in its liquid form or its dry vapor form. The fuel may or may not contain other additives, as desired, in solubilized or emulsified form, although the use of this invention may replace the necessity for such additives because the combustion reaction is carried to completion and the peak cyclic combustion temperatures are reduced.

Studies of the effects of fuel composition and operating conditions on air pollution using commercial fuel mixtures have confirmed the fact that air pollution from this source can be reduced when the fuels are oxidized more completely and combustion products altered to less harmful form. Thus, by using fuels containing micro-particulates as nuclei for fuel droplets which become combustion promoting agents, lean air-fuel limits of stable combustion can be extended and peak cyclic combustion temperatures may be reduced, in accordance with this invention, and a substantial reduction in $NO_x$ air pollution may be obtained.

I claim:

1. A fuel composition for lowering the lean limit of stable combustion of a combustible fuel and air mixture comprising a liquid hydrocarbon fuel having dispersed therein a quantity of discrete particulates of a size of about 10 to 40 microns substantially equivalent in number to the number of similarly sized polyvinyl alcohol particles which would equal in weight about 6% of the weight of a mixture of the said polyvinyl alcohol particles and the said liquid hydrocarbon fuel.

2. A charge for a combustion zone for lowering the lean limit of stable combustion of a combustible fuel and air mixture and accelerating combustion therein comprising a liquid fuel and air mixture having dispersed therein a quantity of discrete particulates having a particle size of about 10 to 40 microns, each particle having an encompassing film of the liquid fuel, and the number of particles contained in the charge being substantially equivalent to the number of similarly sized particles of polyvinyl alcohol which would equal about 6% by weight of a mixture of said polyvinyl alcohol particles and the fluid fuel from which the said charge is formed.

3. A charge for a combustion zone for lowering the lean limit of stable combustion of a combustible fuel and air mixture and accelerating combustion therein comprising a fluid fuel and air mixture having dispersed therein a quantity of discrete particulates having a particle size of about 10 to 40 microns, each particle serving to hold and carry some of the fuel comprising the said charge, and the number of particles contained in the charge being substantially equivalent to the number of similarly sized particles of polyvinyl alcohol which would be equal to about 6% by weight of a mixture of said polyvinyl alcohol particles and the liquid fuel from which the said charge is formed.

* * * * *